US005774072A

United States Patent [19]

Wu

[11] Patent Number: 5,774,072

[45] Date of Patent: Jun. 30, 1998

[54] BUS STOP SIGNALING SYSTEM WITH TWO WAY COMMUNICATION

[76] Inventor: Shang I. Wu, P.O. Box 82-144, Taipei, Taiwan

[21] Appl. No.: 623,117

[22] Filed: Mar. 28, 1996

[51] Int. Cl.[6] ..... G08G 1/123

[52] U.S. Cl. ..... 340/994; 340/539; 340/991; 364/436

[58] Field of Search ..... 340/994, 988, 340/904, 539, 991; 364/436, 569; 455/57.1

[56] References Cited

U.S. PATENT DOCUMENTS

| | | | |
|---|---|---|---|
| 5,021,780 | 6/1991 | Fabiano et al. | 340/994 |
| 5,483,454 | 1/1996 | Lewiner et al. | 340/994 |

FOREIGN PATENT DOCUMENTS

| | | | |
|---|---|---|---|
| WO 93/13510 | 7/1993 | United Kingdom | 340/994 |

*Primary Examiner*—Jeffery Hofsass
*Assistant Examiner*—Anh La
*Attorney, Agent, or Firm*—A & J

[57] ABSTRACT

A bus stop signaling system including a main unit installed in a bus which runs in a particular bus line and controlled to transmit a coded radio signal and to receive a particular radio calling signal, and an auxiliary unit installed in each bus stop to, wherein the auxiliary unit turns on a respective indicator lamp subject to the nature of the coded radio signal being received from the main unit so that the passenger can depress a respective calling button to provide a calling signal to the main unit and to turn on the indicator lamp thereof; the indicator lamp of the main unit is turned off when the passenger gets on the bus and inserts the coin or magnetic card, and the counter of the main unit counts one after the insertion of the coin or magnetic card.

6 Claims, 7 Drawing Sheets

BUS STOP SIGNALING SYSTEM WITH TWO WAY COMMUNICATION

BACKGROUND OF THE INVENTION

1. Field of the Invention

This invention relates to a bus stop signaling system which includes a main unit installed in the bus, and an auxiliary unit installed in each bus stop and controlled by passengers to give a radio calling signal to the bus.

2. Description of the Prior Art

Most people living in cities use city buses as their daily transportation vehicles. Regular city buses commonly run in a particular bus line in which bus stops are set at different distances where passengers await the bus. Because there are various bus lines in a city, and various buses of different bus lines may be stopped at a same bus stop to pick up passengers, passengers must identify the code number of the approached bus before getting on it. However, it is not easy to identify the code number of the approached bus at night or during the dark.

SUMMARY OF THE INVENTION

This invention is concerned with a bus stop signaling system. According to one aspect of the present invention, the bus stop signaling system comprises a main unit installed in a bus which runs in a particular bus line, the main unit including a transmitter unit which is comprised of an encoder and a transmitting circuit, and a receiver unit which is comprised of a receiving circuit, a decoder, a counter, a display, a voice IC, a speaker, and an indicator lamp; and an auxiliary unit installed in each bus stop to receive radio signal from the main unit, and controlled to transmit a radio calling signal to the main unit, the auxiliary unit comprising a receiving circuit, a decoder, a locking circuit, a set of indicator lamps, a timer, an AND gate IC, an encoder, a transmitting circuit, and a set of calling control buttons; wherein the encoder of the transmitter unit of the main unit has a set of signal setting buttons for setting a coded radio signal for transmitting to the auxiliary unit; the encoder of the auxiliary unit has a set of signal output terminals corresponding to the set of signal setting buttons so that when one signal output terminal of the encoder of the auxiliary unit is triggered by the coded radio signal set by one of the signal setting buttons of the main unit, the encoder of the auxiliary unit gives a signal to the locking circuit, causing it to turn on a respective indicator lamp; when one of the calling control buttons is depressed after the corresponding indicator lamp is turned on, the AND gate IC is driven to give a signal to the encoder of the auxiliary unit, causing it to transmit a radio calling signal to the receiver unit of the main unit through the transmitting circuit of the auxiliary unit.

According to another aspect of the present invention, the indicator lamp of the main unit is turned off when the passenger gets on the bus and inserts the coin or magnetic card, and the counter of the main unit counts one after the insertion of the coin or magnetic card.

According to still another aspect of the present invention, the timer of the auxiliary unit automatically resets the locking circuit to turn off the indicator lamps of the auxiliary unit a predetermined length of time after triggering.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
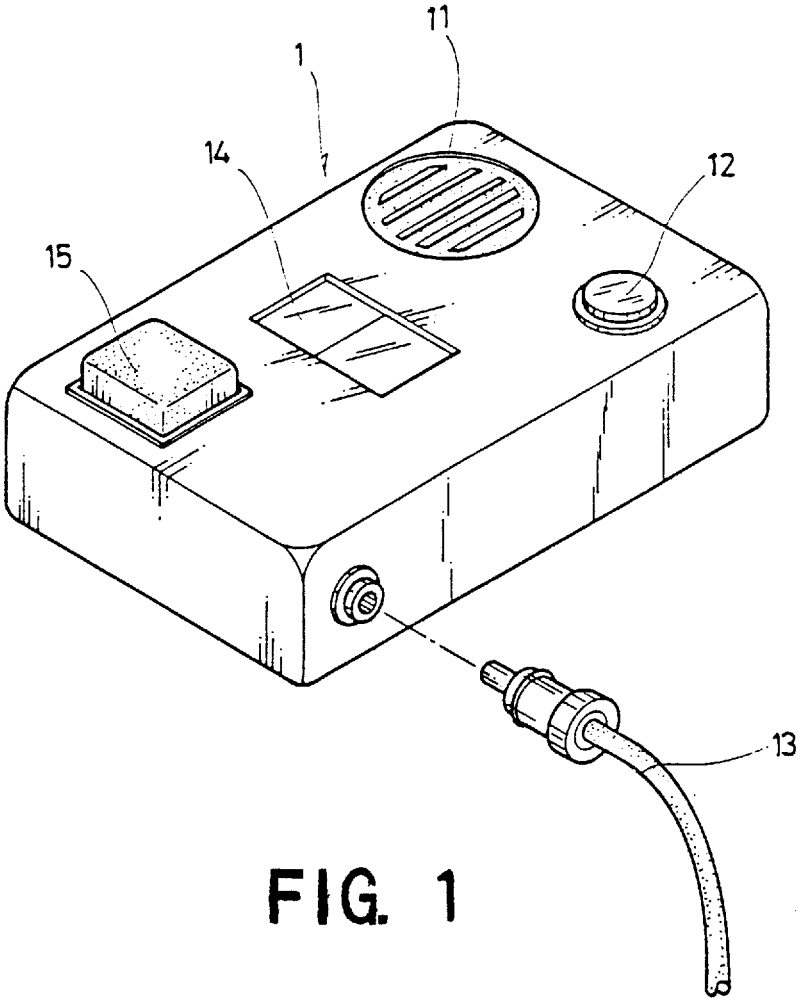
FIG. 1 is an elevational view of the main unit of the bus stop signaling system according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
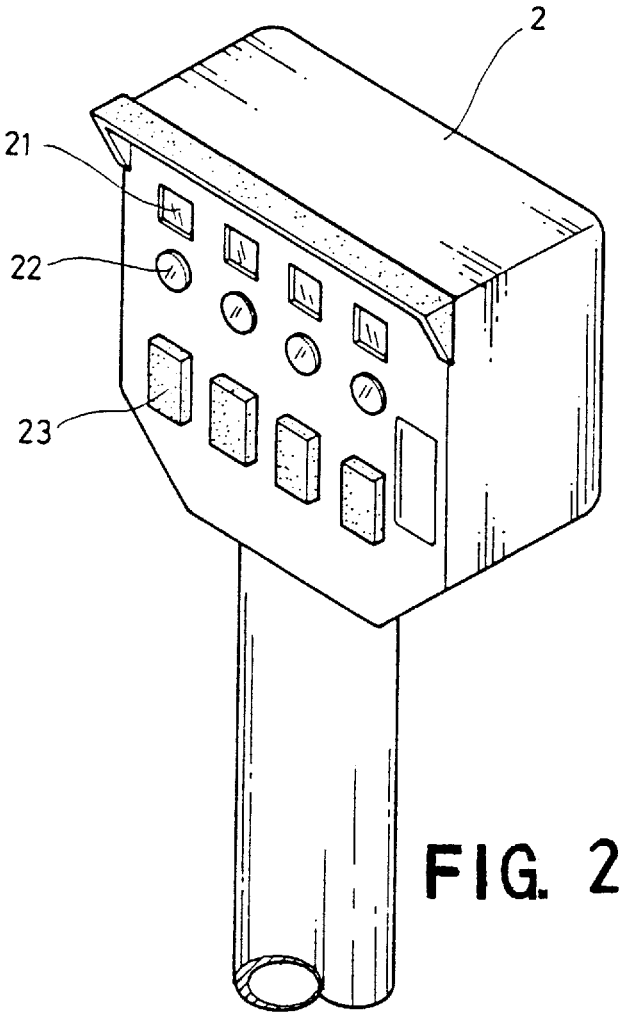
FIG. 2 is an elevational view of the auxiliary unit of the bus stop signaling system according to the present invention.

Referring to FIGS. 1 and 2, a bus stop signaling system includes a main unit 1 installed in the bus, and an auxiliary unit 2 installed in each bus stop. The main unit 1 continuously provides a radio signal of a particular frequency when the bus is running in the course. The auxiliary unit 2 has a set of bus line codes 21, a plurality of indicator lamps 22 and a plurality of buttons 23 corresponding to the bus line codes 21. When the auxiliary unit 2 receives the signal of the main unit 1 of the bus of a particular bus line, the corresponding indicator lamp 22 is turned on, and a passenger can press on the corresponding button 23 to give a radio signal to the main unit 1 of the bus of the corresponding bus line to trigger the speaker 11 and indicator lamp 12 of the main unit 1, causing the speaker 11 to produce sound and the indicator lamp 12 to give off light, and therefore the bus driver knows through the speaker 11 and the indicator lamp 12 that there is a passenger awaiting at the next bus stop. When the passenger gets on the bus and puts the coin in the coin box (or inserts the magnetic card into the magnet card reader), a signal is transmitted from the coin box (or magnetic card reader) through a cable 13 to the main unit 1, causing the main unit 1 to provide a radio release signal to turn off the corresponding indicator lamp 22 of the auxiliary unit 2, and at the same time, the reading of the display 14 is added by one to show the added number of stops the bus reached. The bus driver can also depress a manual release button 15 to provide a radial release signal to turn off the corresponding indicator lamp 22 of the auxiliary unit 2. If any of the buttons 23 is depressed by an error, the corresponding indicator lamp 22 will be turned off after a predetermined length of time.

Figure 3A:
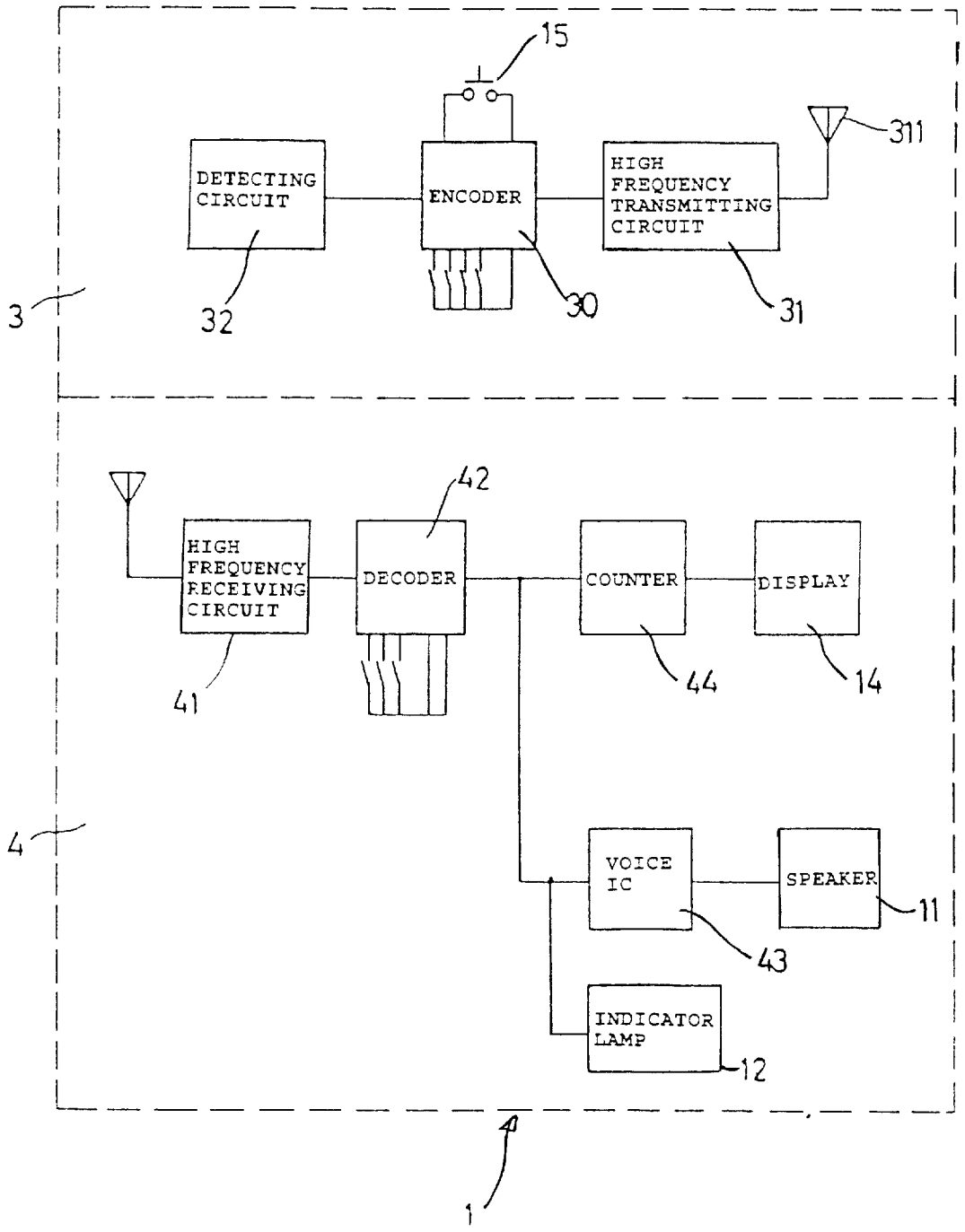
FIG. 3A is a control block diagram of the main unit of the bus stop signaling system according to the present invention.
Figure 3B:
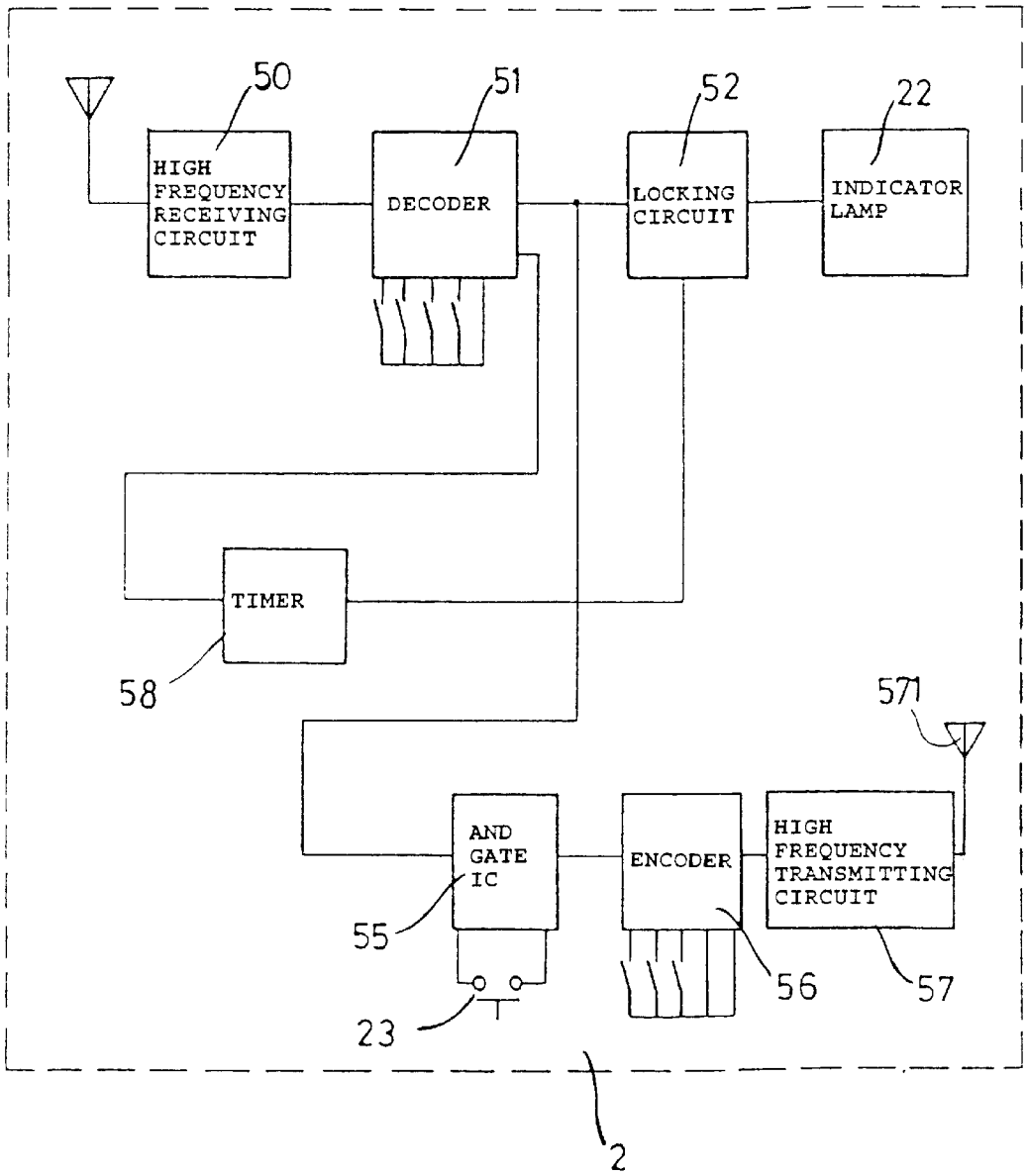
FIG. 3B is a control block diagram of the auxiliary unit of the bus stop signaling system according to the present invention.

Referring to FIGS. 3A and 3B, and FIGS. 1 and 2 again, the main unit 1 is comprised of a transmitter unit 3 and a receiver unit 4. The transmitter unit 3 comprises an encoder 30, a high-frequency transmitting circuit 31, a detecting circuit 32, and a transmitting antenna 311. The receiver unit 4 comprises a high-frequency receiving circuit 41, a decoder 42, a voice IC 43, and a counter 44. The auxiliary unit 2 is comprised of a high-frequency receiving circuit 50, a decoder 51, a locking circuit 52, an AND gate IC 55, an encoder 56, a high-frequency transmitting circuit 57, and a transmitting antenna 571. The encoder 30 provides a coded digital signal to the high-frequency transmitting circuit 31, causing it to send the signal to the auxiliary unit 2 through the transmitting antenna 311. When the high-frequency receiving circuit 50 of the auxiliary unit 2 receives the signal from the transmitting antenna 311 of the transmitter unit 3 of the main unit 1, it is decoded by the decoder 51 and then sent to the locking circuit 52, causing it to turn on the corresponding indicator lamp 22. When the corresponding button 23 is depressed, the AND gate IC 55 is driven to produce a signal to the encoder 56, causing the encoder 56 to encode the signal and then to send the encoded signal to the main unit 1 through the high-frequency transmitting circuit 57 and the transmitting antenna 571. When the high-frequency receiving circuit 41 of the receiver unit 4 of the main unit 1 receives the signal from the auxiliary unit 2, the signal is sent to the decoder 42, causing the decoder 42 to provide a voltage signal to the counter 44, the indicator lamp 12, and the voice IC 43, causing the voice IC 43 to produce sound through the speaker 11 and the counter 44 to add one to the reading of the display 14. When the passenger gets on the bus and inserts the coin in the coin box (or the magnetic card in the magnetic card reader), the detecting circuit 32 is triggered to provide a signal to the encoder 30 of the transmitter unit 3, causing it to send a releasing signal through the transmitting circuit 31 and the transmitting antenna 311 to reset the locking circuit 52 and to turn off the corresponding indicator lamp 22. If there is no passenger at the bus stop, the bus driver can depress the release button 15 to turn off the corresponding indicator lamp 22. If the bus driver does not depress the release button 15, the timer 58 will automatically resets the locking circuit 52 after a predetermined length of time, causing it to turn off the corresponding indicator lamp 22.

Figure 4:
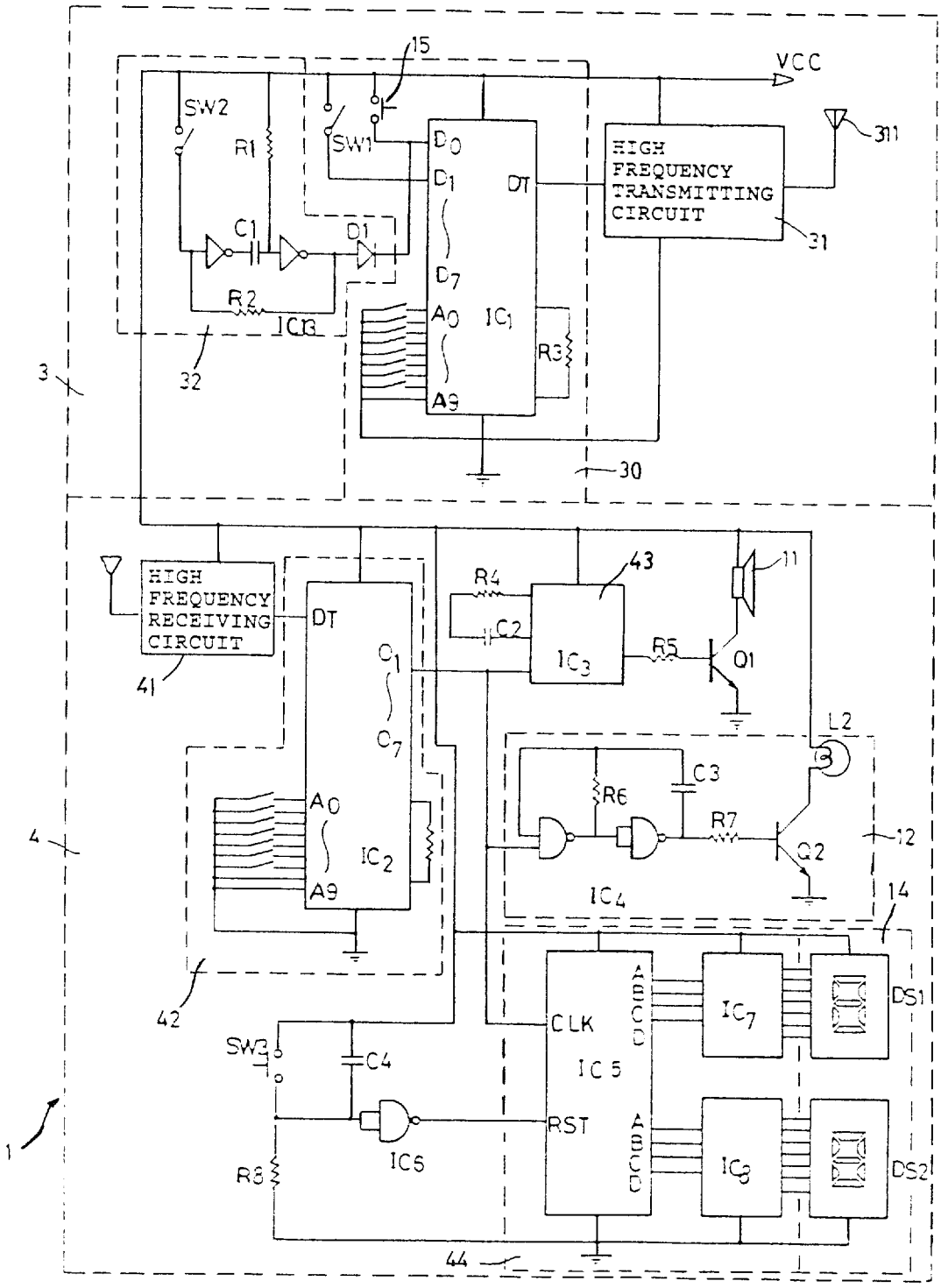
FIG. 4 is a circuit diagram of the main unit of the bus stop signaling system according to the present invention.
Figure 5:
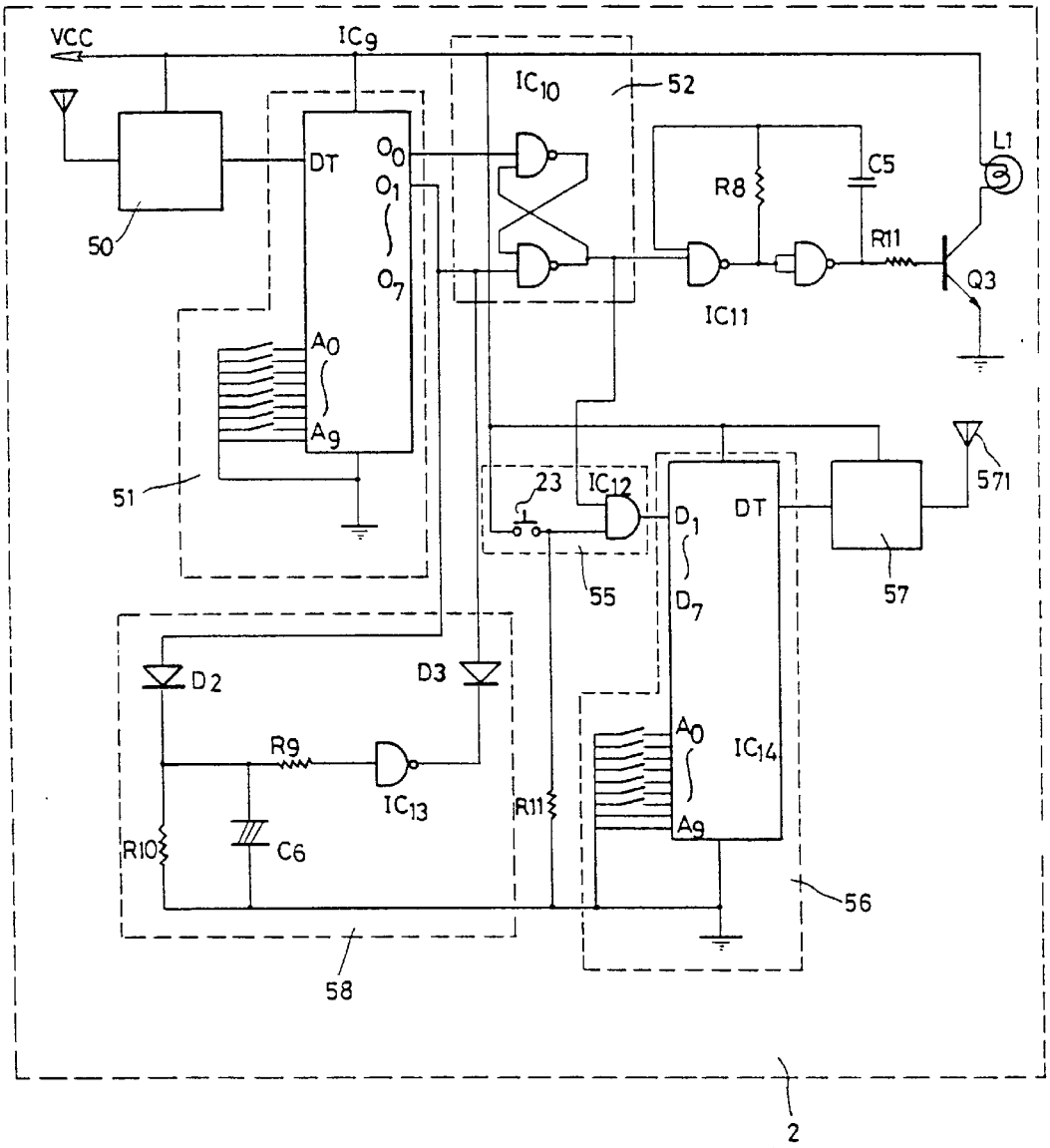
FIG. 5 is a circuit diagram of the auxiliary unit of the bus stop signaling system according to the present invention.

FIG. 4 is a circuit diagram of the main unit 1, and FIG. 5 is a circuit diagram of the auxiliary unit 2. As illustrated, the transmitter unit of the main unit 1 comprises an encoder IC1 of which contacts A0–A9 are for setting a digital code, contacts D0–D7 are for switching. When the contact D1 is switched on by the switch SW1, the contact DT gives a signal to the auxiliary unit 2 through the high-frequency transmitting circuit 31 and the transmitting antenna 311. When the high-frequency receiving circuit 50 of the auxiliary unit 2 receives the signal of the main unit 1, it gives a voltage signal to the decoder IC9. The decoder IC9 immediately compares the voltage signal with its digital code A0–A9. When the received voltage signal is identified, the output terminal 01 of the decoder IC9 immediately triggers a flip-flop IC10, causing the oscillating circuit IC11, the resistor R8, and the capacitor C5 to provide an oscillating pulse wave. The oscillating pulse wave is then sent to the transistor Q3, causing it to turn on the indicator lamp L1. When the passenger presses on the corresponding button 23, a high voltage signal is transmitted to the output end of the flip-flop IC10, then to the encoder IC14 via the IC12, causing DT to transmit a radio calling signal through the high-frequency transmitting circuit 57. When the high-frequency receiving circuit 41 of the main unit 1 receives the signal of the high-frequency transmitting circuit 57, the signal is decoded by the decoder IC2 and compared with the digital code A0–A9 of the encoder IC14. When the signal is identified, the voice IC IC3 and the oscillating circuit which is formed of the IC4, the resistor R6, and the capacitor C3 are triggered, causing the transistor Q1 and the transmitter Q2 to respectively turn on the speaker 11 and the indicator lamp L2. At the same time, the triggering signal starts the counter IC5 to count one, and to drive the driving circuits IC7, IC8, so as to show the reading through the displays DS1, DS2. When the passenger gets on the but and inserts the coin into the coin box (or the magnetic card into the magnetic card reader), the switch SW2 of the transmitter unit 3 is switched on to drive the signal shot triggering circuit, which is comprised of an IC13, a capacitor C1, and a resistor R1, causing the signal shot triggering circuit to provide a transient pulse wave signal to the auxiliary unit 2. When the auxiliary unit 2 receives the signal, the contact D0 of the IC IC9 immediately resets the flip-flop IC9 and turns off the transistor Q3, and therefore the indicator lamp L1 is turned off. If the bus driver depresses the release button 15, or the timer which is comprised of an IC IC6, a capacitor C6, and a resistor R9 counts up a predetermined length of time, a reset pulse signal is sent through D3 to resets the flip-flop IC9 and to turn off the indicator lamp L1.

Figure 6:
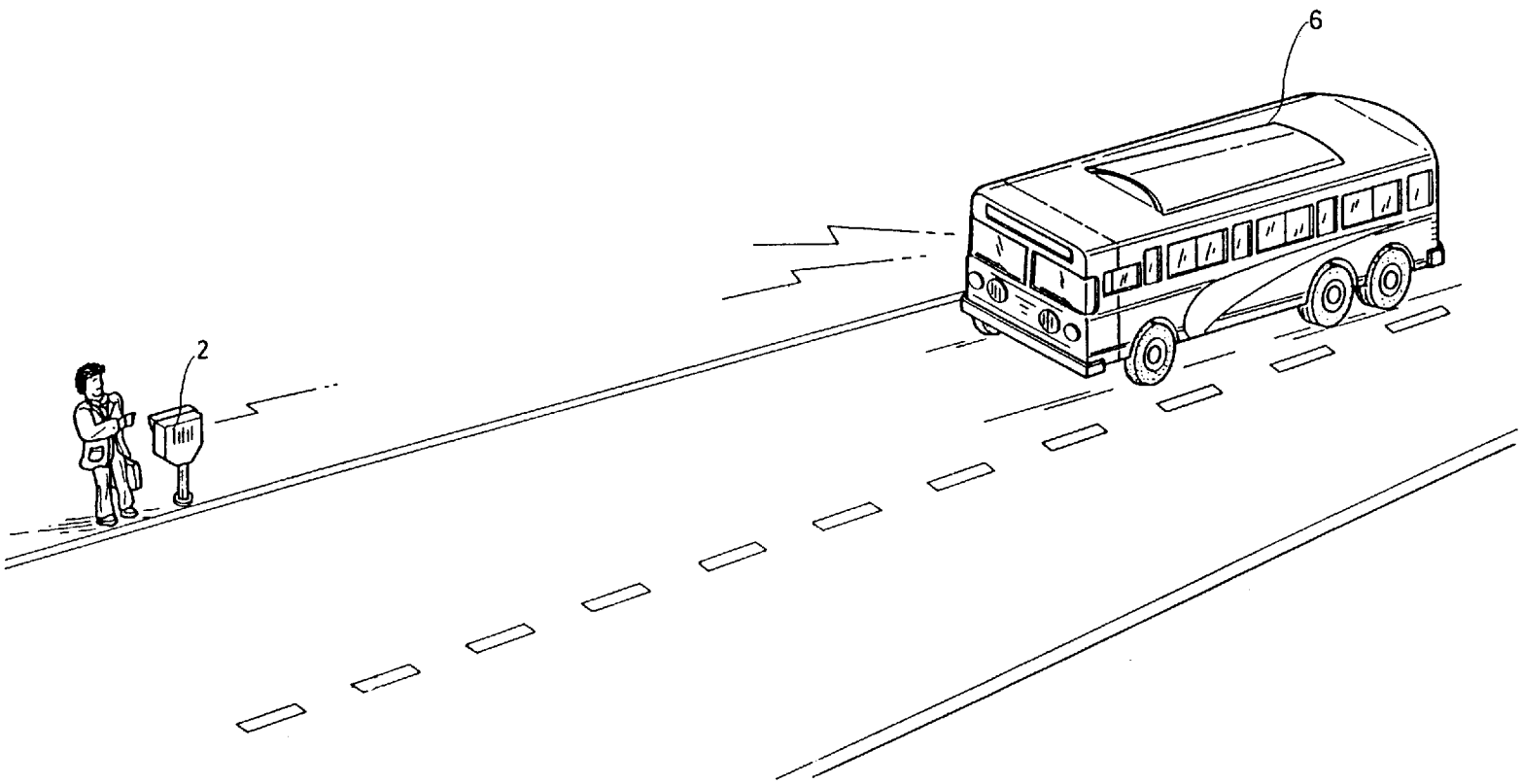
FIG. 6 is an applied view of the present invention.

Referring to FIG. 6, when the bus 6 runs into the detecting range of the auxiliary unit 2, the passenger knows the bus of a particular bus line comes soon and can depress the corresponding button to call the bus 6.

The present invention can also be used in a taxi stop signaling system by eliminating the transmitter unit from the main unit. When a passenger depresses the button of the auxiliary unit at one taxi stop, the main unit is immediately triggered to turn on the speaker and the indicator lamp if the taxi runs into the effective range of the auxiliary unit.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A bus stop signaling system comprising:

a main unit installed in a bus which runs in a particular bus line, said main unit including a transmitter unit which is comprised of an encoder and a transmitting circuit, and a receiver unit which is comprised of a receiving circuit, a decoder, a counter, a display, a voice IC, a speaker, and an indicator lamp, and an auxiliary unit installed on each bus atop to receive radio signal from said main unit, and controlled to transmit a radio calling signal to said main unit, said auxiliary unit comprising a receiving circuit, a decoder, a locking circuit, a set of indicator lamps, a timer, an AND gate IC, an encoder, a transmitting circuit, and a set of calling control buttons;

wherein the decoder of said auxiliary unit has a set of signal output terminals corresponding to a coded radio signal transmitted by the encoder and the transmitting circuit of the main unit so that when one signal output terminal of the encoder of said auxiliary unit is triggered by said coded radio signal transmitted by the encoder and the transmitting circuit of said main unit, the decoder of said auxiliary unit gives a signal to said looking circuit, causing it to turn on a respective indicator lamp; when one of said calling control buttons is depressed after the corresponding indicator lamp is turned on, said AND gate IC in driven to give a signal to the encoder of said auxiliary unit, causing it to transmit a radio calling signal to the receiver unit of said main unit through the transmitting circuit of said auxiliary unit.

2. The bus stop signaling system as claimed in claim 1 wherein the encoder circuit of the transmitter unit of said main unit is connected to a single shot triggering circuit, which is triggered to provide a releasing signal to said auxiliary unit through the transmitting circuit of the transmitter unit of said main unit when the passenger inserts the coin into the coin box or the magnetic card into the magnetic card reader in the bus, causing said auxiliary unit to turn off the corresponding indicator lamp.

3. The bus stop signaling system as claimed in claim 1 wherein the counter and voice IC of the receiver unit of said main unit are connected in parallel to the decoder thereof so that said counter counts and shows the reading through said display when the receiving circuit of the receiver unit of said main unit receives the calling signal from said auxiliary unit.

4. The bus stop signaling system as claimed in claim 1 wherein said locking circuit of said auxiliary unit is comprised of a plurality of flip-flops, said flip-flops having respective starting terminals and reset terminals respectively connected to different output terminals of the decoder of said auxiliary unit.

5. The bus stop signaling system as claimed in claim 4 wherein the input terminal and output terminal of the timer of said auxiliary unit are respectively connected to the starting terminals and reset terminals of the flip-flops of said locking circuit so that said timer automatically resets said locking circuit to turn off the indicator lamps of said auxiliary unit a predetermined length of time after triggering.

6. The bus stop signaling system as claimed in claim 1 wherein said main unit can be installed in a taxi when the transmitter unit of said main unit is eliminated, and the taxi driver is called when the receiver unit receives a calling signal from said auxiliary unit.

* * * * *